United States Patent [19]

Hayes

[11] Patent Number: 4,870,707

[45] Date of Patent: Oct. 3, 1989

[54] MULTIPLE-PURPOSE SCARF

[76] Inventor: Alia S. Hayes, 177 Center St., Concord, N.H. 03301

[21] Appl. No.: 199,385

[22] Filed: May 27, 1988

[51] Int. Cl.[4] ..... A41D 23/00; A41D 3/08

[52] U.S. Cl. ..... 2/207; 2/88; 2/144; 2/243 B; 2/279

[58] Field of Search ..... 2/49 R, 88, 122, 133, 2/131, 243 B, 144, 146, 207, 279, 129

[56] References Cited

U.S. PATENT DOCUMENTS

| | | | |
|---|---|---|---|
| 2,639,431 | 5/1953 | Spear | 2/88 |
| 3,080,566 | 3/1963 | Neumann | 2/207 X |
| 3,360,802 | 1/1968 | Kasamatsu | 2/207 |
| 3,894,296 | 7/1975 | Hirschbeck | 2/144 |

OTHER PUBLICATIONS

Johansen, Ginnie "How-To" (1987).

*Primary Examiner*—Werner H. Schroeder

*Assistant Examiner*—Sara M. Current

*Attorney, Agent, or Firm*—Wolf, Greenfield & Sacks

[57] ABSTRACT

A scarf has a generally butterfly-like configuration formed with two mirror-image, generally triangular panels and a connecting neck portion which is preferably pleated. The scarf extends laterally along the straight grain of the fabric to two corners of the triangular panels, and along the bias of the fabric to second corners of the triangular panels. The fabric is a fluid, drapable fabric, preferably pure silk or a silk blend. The scarf can be cut as a single integral piece, or as two pieces joined in a seam at the neck portion. The dimensions of the fabric depend on the size of the person wearing it and its use. In a large size, the scarf can be draped around the neck for use as a stole, dickey, bandeau or halter blouse, with at least one pair of the corners tied at the back. In any size, the scarf can be tied and displayed to provide a wide variety of scarf bows and styles.

10 Claims, 9 Drawing Sheets

FIG. 12B
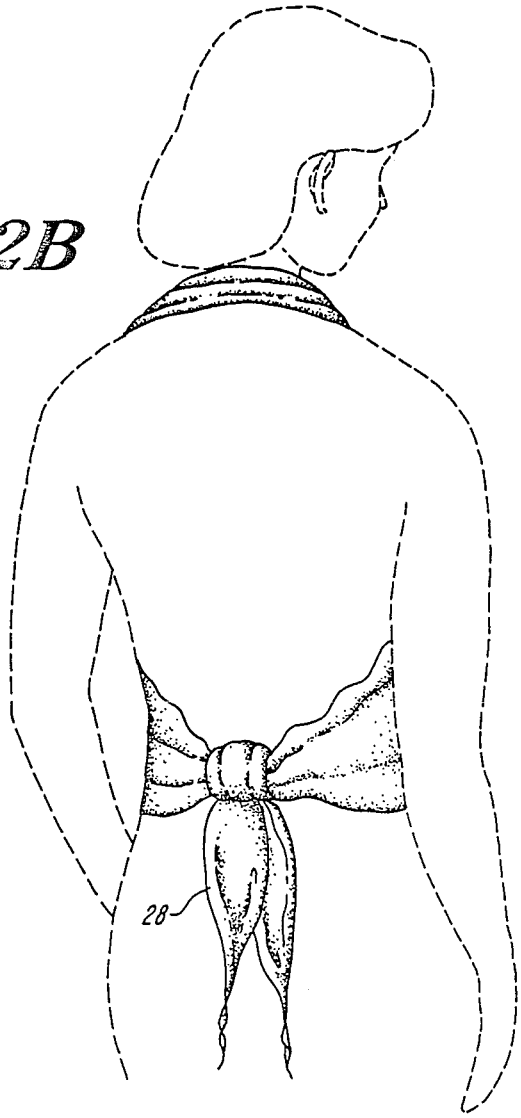
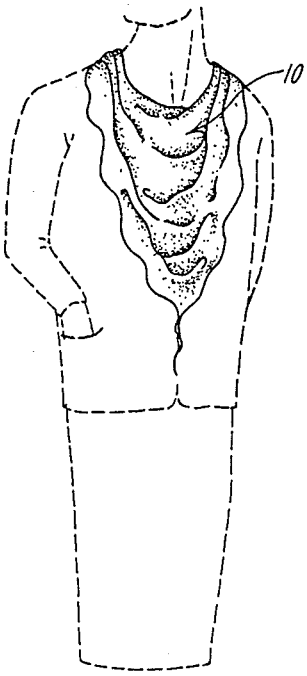
FIG. 14

MULTIPLE-PURPOSE SCARF

BACKGROUND OF THE INVENTION

This invention relates in general to apparel, and in particular to a scarf that can be adapted for use as a different article of clothing, particularly, a halter blouse, dickey, bandeau or stole.

Scarves usually are made from a single piece of textile having a square, rectangular, or triangular configuration. Known scarves are made from a very wide assortment of materials and are worn in a wide variety of styles, including conventional neck scarves, head wraps, head bows, shoulder wraps and as shawls or stoles. These scarves are accessory items. Their configuration limits their uses.

Conventional halter blouses and dickeys are multiple piece garments that typically include at least a front panel, a neck strap, and ties. Conventional scarves are not used as halters, dickeys, or bandeaus, and conversely, conventional halters, dickeys or bandeaus are not used as scarves.

In men's apparel, scarves are typically either a long, rectangular item worn around the neck under a coat, or an ascot. Known men's ascots are generally rectangular pieces of a suitable textile that is gathered and stitch pleated at its center. The ascot configuration has not been adopted for women's wear, and while it could function as a neck scarf, it cannot be used readily as any other type of apparel.

It is therefore a principal object of the present invention to provide a woman's scarf that can also be used as a halter blouse, dickey, bandeau or stole.

Another object is to provide a scarf with the foregoing advantage that ties readily drapes well, and can stretch to accommodate being tied around the torso.

A further object of the invention is to provide a scarf with the foregoing advantages that can be manufactured with an economic use of fabric and labor.

SUMMARY OF THE INVENTION

A scarf formed of a fluid, drapable fabric has a generally butterfly-like configuration with two triangular panels joined at a neck portion that is preferably stitch pleated. The triangular panels are mirror images of one another about the vertical center line of the scarf through the neck portion. In the preferred form the upper edges of the triangular panels and the neck portion are generally aligned prior to pleating and extend laterally along a first direction to first corners. Second edges of the triangular panels form an acute angle with the first edges at the first corner (or "point") and extend generally downwardly to second corners (or "points").

The third corner of each triangular panel is in effect trimmed at the neck portion. A third edge extends from the second corner to the neck portion. The fabric is preferably silk or a silk blend with its straight grain extending along the first direction and the bias in the fabric being generally aligned with the second and third edges. Width of the scarf measured along the first direction is preferably sufficient so that when the scarf is placed with its neck portion about the neck of its wearer, the first corners may be crossed and tied to one another at the wearer's back. Preferably the configuration and dimensions of the scarf also allow the second corners to be tied to one another, also at the back.

The scarf, when used as a scarf, can be tied at either its first or second corners to create a wide variety of "looks". For example, with the second corner tied to one another and the first corners can be looped behind and over the tie. In another form, the first corners can be tied with the second corners hanging free. In yet another form, the pleated neck portion lies on one shoulder and the first ends are tied to one another over the other shoulder.

These and other features and objects of the invention will be more fully understood in light of the following detailed description which should be read in light of the accompanying drawings.

BRIEF DESCRIPTION OF THE DRAWINGS

FIGS. 3–7 are views in front elevation showing the scarf of FIGS. 1 and 2 utilized as a decorative scarf in various styles;

FIGS. 12A and 12B are front and rear views in perspective of the scarf shown in FIGS. 1 and 2 tied in an alternate manner as a halter blouse;

FIGS. 13 and 14 views in perspective of the scarf shown in FIGS. 1 and 2 tied for use as a scarf or a dickey;

DETAILED PREFERRED EMBODIMENTS

Figure 1:
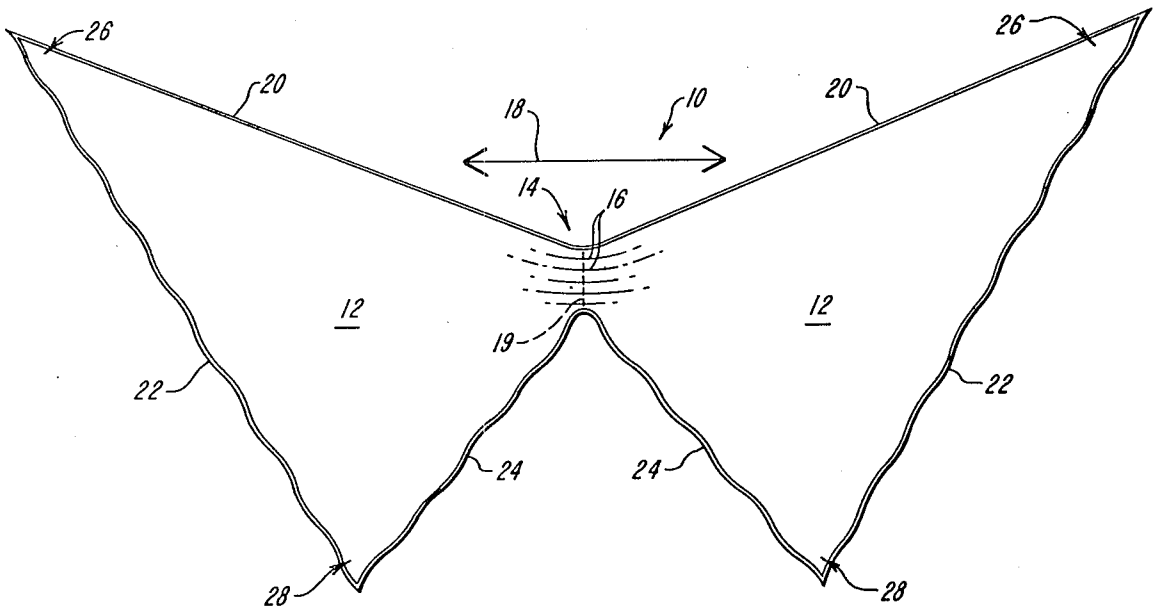
FIG. 1 is a top plan view of a multi-purpose scarf according to the present invention.
Figure 2:
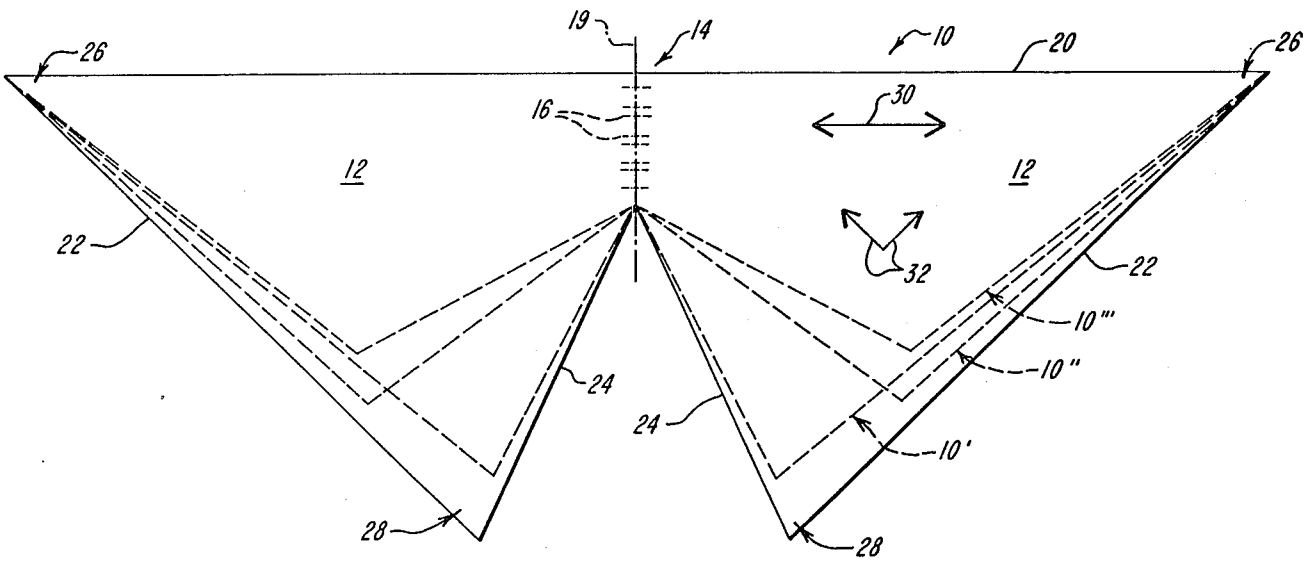
FIG. 2 is a top plan view of the scarf shown in FIG. 1 before it is stitch pleated, with alternate dimensions and configurations shown in phantom.

FIGS. 1 and 2 show a scarf 10 according to the present invention. It has generally triangular panels 12, 12 joined by a connecting neck portion 14 that is stitch pleated with each pleat 16 extending laterally along the direction of arrow 18. The panels 12, are mirror images of one another with respect to a vertical center line 19 through the neck portion 14. Each triangular panel has an upper or first edge 20, a second edge 22 and a third edge 24. In the preferred form the upper edges 22 of each panel blend into the upper edge of the neck portion 14 and they extend generally laterally along the direction 18. When the neck portion is pleated, the upper edges 22 develops a slope, as shown, where the scarf is laid flat. The edges 20 and 22 meet in a first corner 26 at an acute angle. (The corners are also referred to herein as "points".) Where the scarf is worn with the pleated neck portion around the neck, the points 26, 26 are the "long" ends of the scarf. The sides 22 and 24 of each panel 12 meet at a "short" end or point 28 of the scarf. The panels 12, 12 are not in fact perfectly triangular since the third corners are in effect trimmed at the neck portion. Also, the panels need not otherwise be perfectly triangular. For example, the corners 26 and 28 can be rounded and the sides can be non-linear, for example, bowed, scalloped or tassled. In the preferred form, the edges 20, 22 and 24 are finished by beading, serging, hand rolling, or the like. The edge finish is preferably in a decorative color which contrasts with that of the fabric of the scarf and introduces indulations from the plane of the panels 12 at the edges which provides a fluffy, decorative effect.

Figure 3:
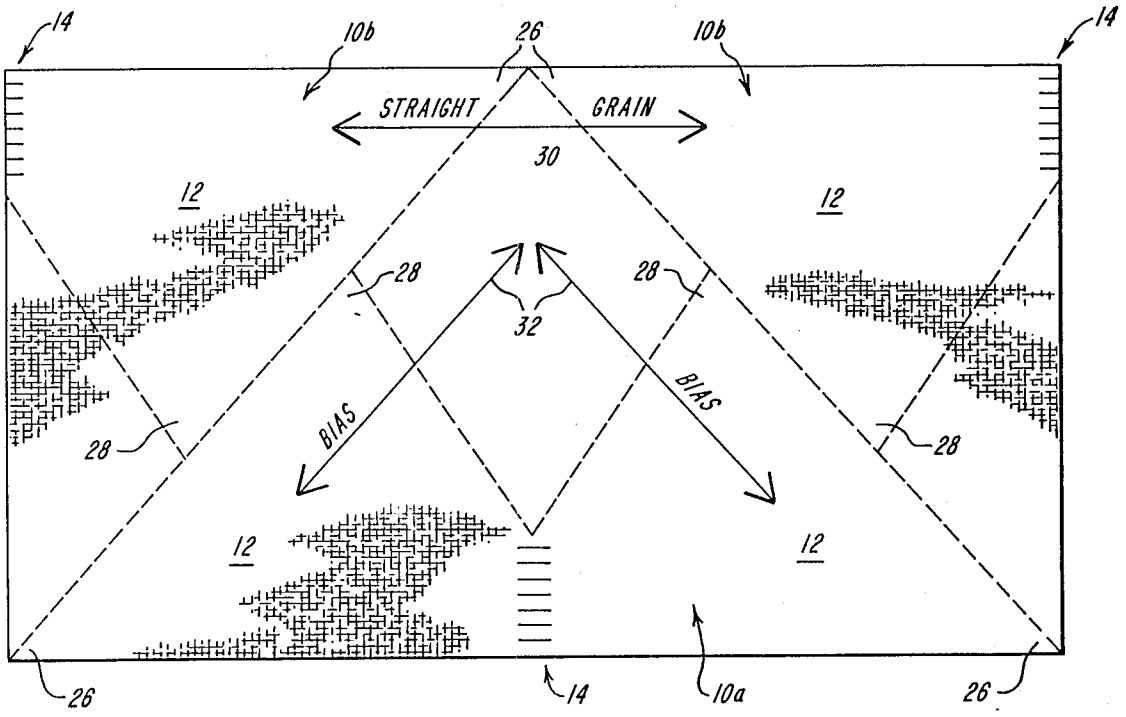
FIG. 3 is a plan view of a length of fabric with cut lines indicated to produce two scarves as shown in FIGS. 1 and 2.

The scarf is preferably formed from a fabric that is fluid and drapable to provide a good drape and good tying qualities. More specifically, the fabric is a single ply, unlined, pure silk or silk blend. The scarf is cut, as shown in FIGS. 2 and 3, from a length of fabric having a standard bolt width such as 55 inches. FIG. 3 shows how two yards of this width is cut (along the dashed lines) to form two scarves 10, one scarf 10*a* being a single piece and the other scarf 10*b* being formed in two pieces that are sewn together, as with a French seam, along the centerline 19. To produce the proper characteristics in use, the straight grain 30 of the fabric is generally aligned with the direction 18 and the fabric bias 32 is generally aligned with the edges 22 and 24 (FIG. 2). This orientation of the fabric weave produces a scarf that lies well when worn and stretches easily in directions that require a stretching capability for certain uses, as described in more detail below. It should be noted that the fabric waste is comparatively small.

FIG. 2 illustrates several different sizes of the scarf 10. The solid line scarf 10 is the largest. It is suitable for use both as a decorative scarf, as well as a halter blouse, dickey, bandeau or stole even when worn by a tall or full-figured woman. The scarf 10' shown in phantom lines is likewise of a size to be used in multiple ways, but it is adapted for use by a woman of shorter stature or a more petite figure. The scarves 10'' and 10''' are shorter, than the vertical direction, and find application principally as a scarf, shawl or stole.

Figure 5:
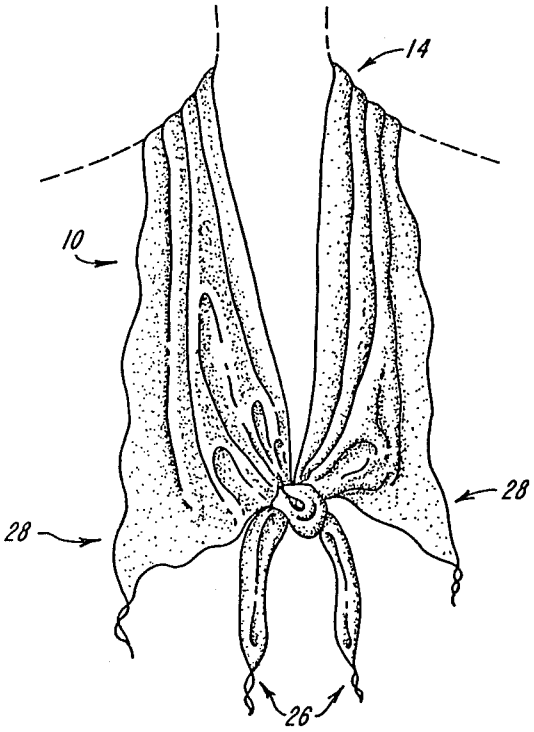
Figure 4:
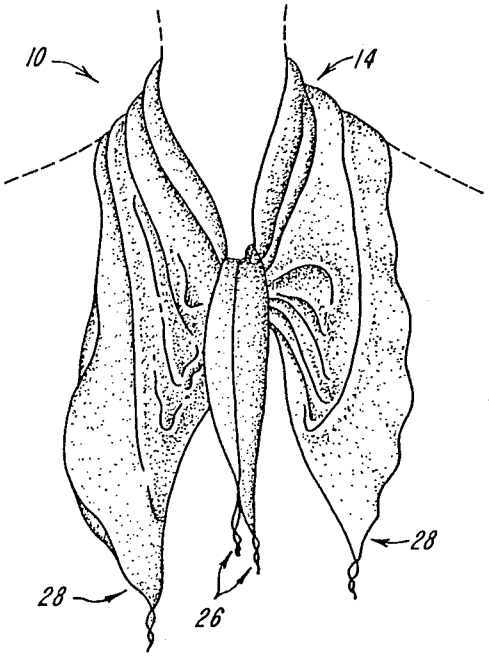
Figure 7:
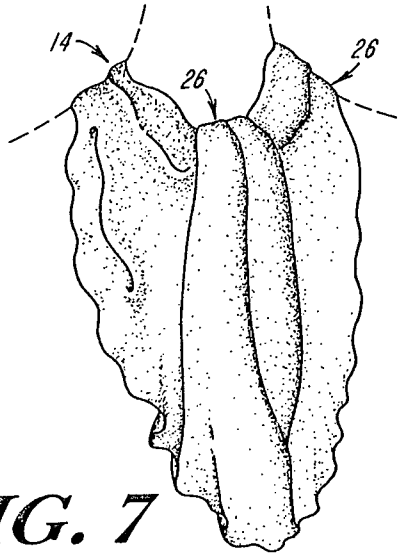
Figure 6:
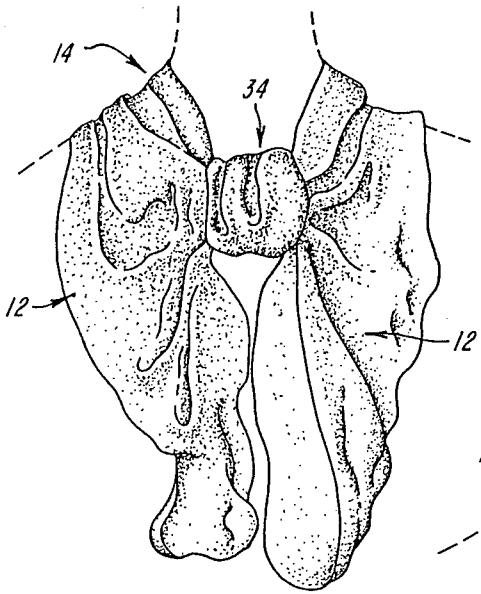

FIGS. 4–7 show the scarf 10 used as a decorative scarf. In each of these Figures, the neck portion 14 is looped around the back of the neck of the person wearing the scarf, as shown. The look of FIG. 4 results from looping one "long" end 26 over the other, with the "short" ends 28, 28 draped freely. FIG. 5 shows a variation on FIG. 4 where the long ends 26, 26 are tied low, in a bow, to product a plunging, evening look. FIG. 6 shows the scarf 10 tied in a "butterfly" configuration with the long points 26, 26 tied in a loose knot 34 between the neck and the breasts with the loose points then tucked into a blouse. FIG. 7 shows the scarf with the long points tied close to the neck, then one long point 26 tossed back over the shoulder and the other long point 26*b* with its tip tucked under the "tossed-back" point.

Figure 8:
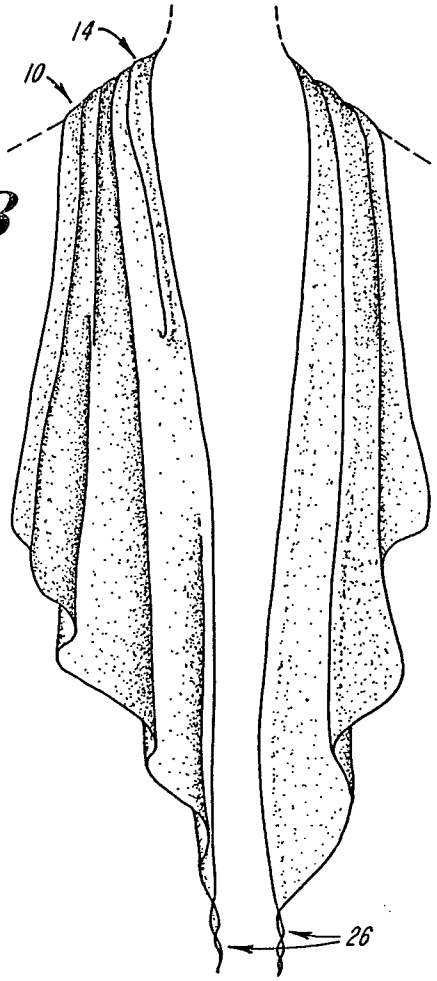
FIGS. 8 and 9 are views in perspective showing the scarf of FIGS. 1 and 2 used as a stole or shawl.
Figure 9:
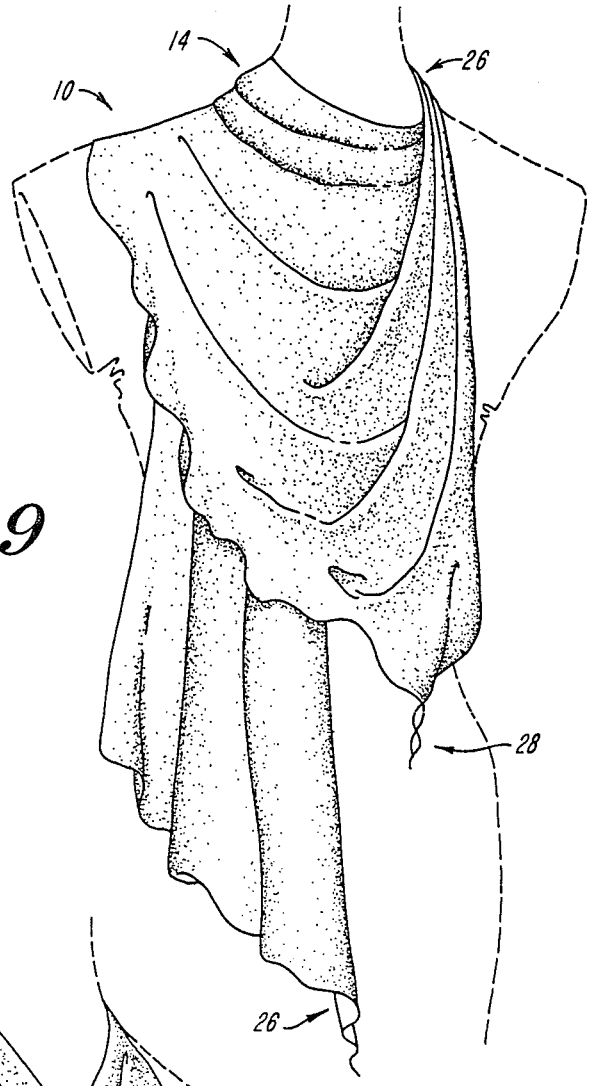

FIGS. 8 and 9 show the scarf 10 used as a stole or shawl. In FIG. 8 the scarf 10 simply is looped around the neck and drapes freely, as shown. In FIG. 9 one long point is tossed over the opposite shoulder.

Figure 10:
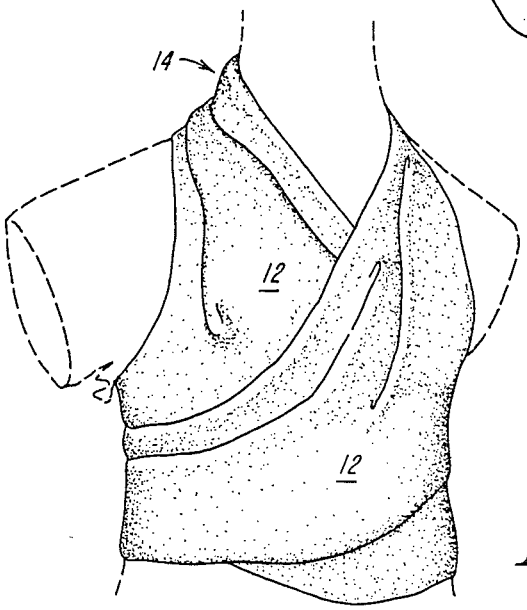
FIGS. 10 and 11 front and rear are views in perspective showing the scarf of FIGS. 1 and 2 used as a halter blouse.
Figure 11:
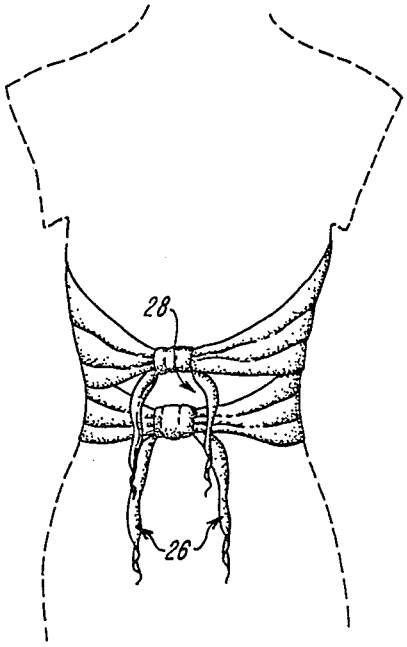
Figure 12A:
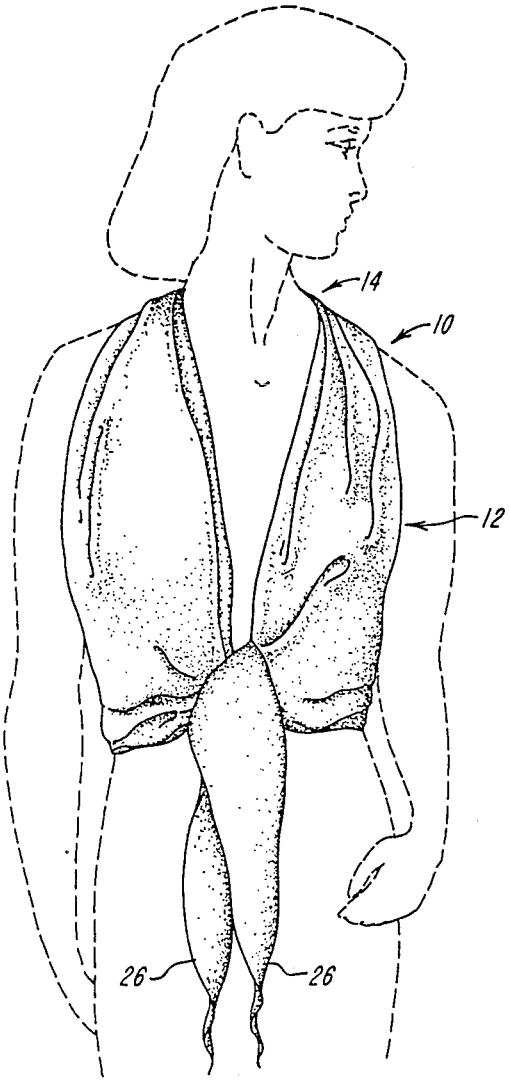

FIGS. 10–12B show the scarf 10 used as to halter blouse. In FIG. 10 the neck portion 14 is again looped behind the neck. The triangular panels 12, 12 are then crossed over one another with their corners 26, 28 tied to one another at the back as shown in FIG. 11. This allows, for example, the scarf 10 to be worn as an accessory to a suit suitable for business attire, and then be retied as a halter and worn with the same suit for a more casual, social attire. FIGS. 12A and 12B shows the same scarf 10 tied as a halter, but with a more plunging neckline to give a less conservative look.

Figure 15:
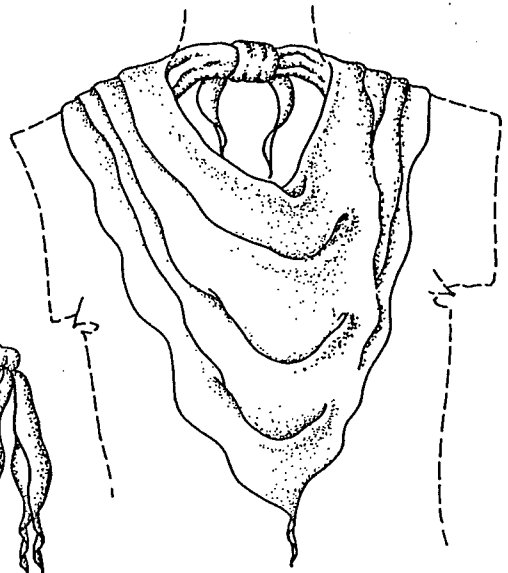
FIG. 15 is a view in perspective of the scarf shown in FIGS. 1, 2 and 14 which can be worn as a scarf or a dickey.
Figure 16:
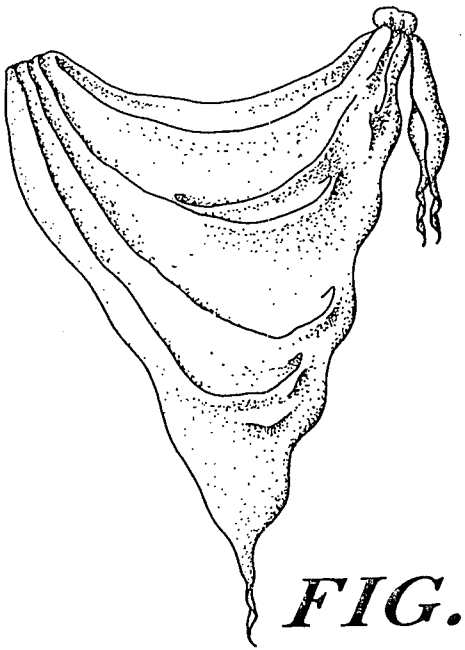
FIG. 16 is a view in perspective of the scarf shown in FIGS. 1 and 2 with the neck pleat worn on a shoulder and used as either a scarf or a dickey.
Figure 13:
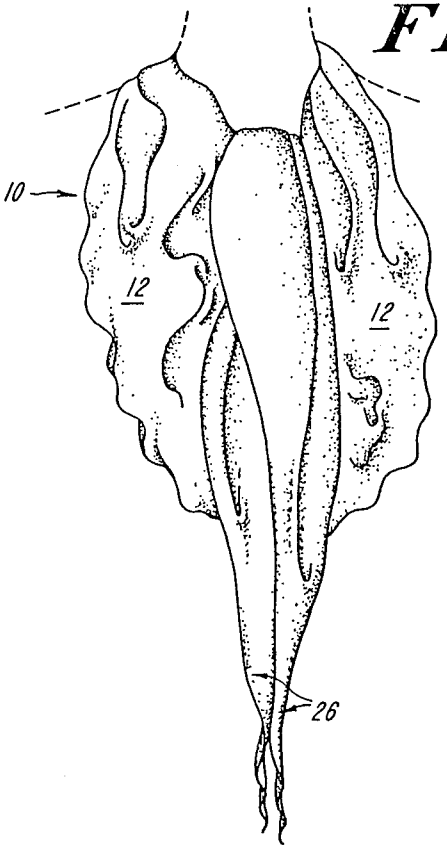

FIG. 13 shows the scarf 10 tied to act as either a scarf or a dickey. The long ends 26, 26 are looped around one another in a loose tie close to the neck. The ends 26, 26 are pulled through the tie so that they hang loosely, as shown. The rest of the panels 12, 12 are gathered toward the tie to create a ruffled dickey. The corners 26,26 can be left loose or tucked into a skirt. When worn with a suit jacket, the scarf simulates the front of a full blouse, thus acting like a dickey. FIG. 14 shows the scarf 10 tied as a cowl and worn with a suit jacket as a dickey. FIG. 15 shows the scarf 10 tied with a knot behind the neck to produce a solid front of fabric for use as a dickey as shown in FIG. 14. FIG. 16 shows the scarf 10 with its pleated neck portion 14 worn on one shoulder and its long points tied together over the opposite shoulder to be worn as scarf, dickey or stole.

There has been described a simple, yet highly versatile and elegant woman's garment that serves either (1) as an accessory or accent piece to a basic wardrobe item such as a dress, suit jacket or blouse, or (2) as a principal garment in itself, whether as a halter blouse, dickey, bandeau or stole. In either form, the scarf is susceptible to being tied, tossed, looped or tucked in a variety of combinations to offer a wide variety of looks with only one simple item of apparel. The scarf is readily convertible from a conservative business look or use, to one more suitable for social or evening use. This extreme degree of versatility is provided with a configuration that makes efficient use of the costly fabric required for good fluidity and draping.

While the invention has been described with respect to its preferred embodiment, it will be understood that various modifications and alterations will occur to those skilled in the art from the foregoing detailed description and the accompanying drawings. For example, while the neck portion has been shown as stitch pleated, it can be unpleated, with some attendant loss in versatility in tying the scarf. Also, the grain and bias in the fabric can be differently oriented, but with a significant adverse effect on the drape and "lay" of the scarf. Materials other than silk and silk blends can be used, but, again, there is a significant loss in the quality of appearance of the garment. For example, if the scarf is used only as a stole or scarf, it is possible to form it from a soft, pliable fur such as mink to create a versatile fur accent piece/-stole. These and other modifications and variations are intended to fall within the scope of the appended claims.

What is claimed is:

1. A multi-purpose woman's garment comprising a piece of a fabric that has a butterfly configuration including a pair of mirror image, generally triangular panels arranged along a first direction on opposite sides of a central neck portion joining the triangular panels, each of said triangular panels having a third corner that is trimmed at said neck portion, said neck portion being pleated with said pleats extending generally along said first direction over substantially the full height of said neck portion in a direction perpendicular to said first direction.

2. The multi-purpose garment of claim 1 wherein said fabric is fluid and drapable.

3. The multi-purpose garment of claim 2 wherein said fabric is selected from the group consisting of silk and silk blends.

4. The multi-purpose garment of claim 1 wherein said triangular panels and neck portion are formed from a single piece of said fabric.

5. The multi-purpose garment of claim 1 wherein said triangular panels and the adjoining portion of said neck portion are each formed from a single piece of said fabric that are secured to one another at said neck portion to form said scarf.

6. The multi-purpose garment of claim 1 wherein a first side of each of said triangular panels extends generally along said first direction to a first corner and they are generally coincident with the upper edge of said neck portion.

7. The multi-purpose garment of claim 6 wherein second and third edges of each triangular panel meet at a second corner, and said first and second edges meet at said first corner at an acute angle.

8. The multi-purpose garment of claim 2 wherein the straight grain of said fabric is generally aligned with said first direction and the bias in said fabric is generally aligned with said second and third edges.

9. The multi-purpose garment of claim 1 for use as a halter blouse wherein said garment extends along said first direction a sufficient distance so that when said neck portion is draped around the neck the first corners can be tied at the back.

10. The multi-purpose garment of claim 9 wherein said second corners are spaced from said first edge a sufficient distance that they also can be tied at the back.

* * * * *